US012246910B2

(12) United States Patent
Shaner et al.

(10) Patent No.: US 12,246,910 B2
(45) Date of Patent: Mar. 11, 2025

(54) LARGE FORMAT CONTAINER

(71) Applicant: ENTEGRIS, INC., Billerica, MA (US)

(72) Inventors: William J. Shaner, Colorado Springs, CO (US); Andrew McKenzie, Sauk Rapids, MN (US); Michael W. Johnson, St. Louis Park, MN (US)

(73) Assignee: ENTEGRIS, INC., Billerica, MA (US)

( * ) Notice: Subject to any disclaimer, the term of this patent is extended or adjusted under 35 U.S.C. 154(b) by 80 days.

(21) Appl. No.: 17/985,628

(22) Filed: Nov. 11, 2022

(65) Prior Publication Data

US 2023/0150760 A1 May 18, 2023

Related U.S. Application Data

(60) Provisional application No. 63/278,853, filed on Nov. 12, 2021.

(51) Int. Cl.

*B65D 88/12* (2006.01)
*B65D 90/00* (2006.01)
*B65D 90/04* (2006.01)

(52) U.S. Cl.

CPC ..... *B65D 88/12* (2013.01); *B65D 90/0033* (2013.01); *B65D 90/046* (2013.01); *B65D 2588/12* (2013.01); *B65D 2588/545* (2013.01); *B65D 2590/043* (2013.01)

(58) Field of Classification Search

CPC .. B65D 88/12; B65D 90/0033; B65D 90/046; B65D 2588/12; B65D 2588/545; B65D 2590/043; B65D 2590/046; B65D 88/06

See application file for complete search history.

(56) References Cited

U.S. PATENT DOCUMENTS 5,597,085 A * 1/1997 Rauworth ..... B65D 77/06 220/639
6,244,459 B1 * 6/2001 Bouc ..... B65D 19/18 220/636
2006/0032857 A1 2/2006 Stensbol et al.
2009/0255927 A1 * 10/2009 Flecknoe-Brown ..... C12H 1/22 426/11

(Continued)

FOREIGN PATENT DOCUMENTS

JP 2020158129 A 10/2020
WO 2021138192 A1 7/2021

*Primary Examiner* — Kareen K Thomas

(57) ABSTRACT

Large format polymeric containers formed by injection molding include a main body having internal surfaces of high density and smoothness that define the internal space. The large format containers can include external features such as reinforcement ribs that are formed integrally with the container body, the reinforcement ribs having greater thicknesses than other portions of the walls of the container. The internal surfaces can include rounded corners and sloping towards a center of the container. Methods of manufacturing the large format polymeric containers include forming the polymeric main body using injection molding. The polymeric main body can be formed of multiple injection molded parts that are joined, or formed as a single piece. The injection molding can include applying between approximately 700 bar and approximately 1100 bar of pressure where at least a portion of the internal surface contacts a mold surface.

18 Claims, 4 Drawing Sheets

(56) References Cited

U.S. PATENT DOCUMENTS

| | | | | |
|---|---|---|---|---|
| 2015/0108037 | A1* | 4/2015 | Evans | B65D 19/18 108/50.11 |
| 2016/0221729 | A1* | 8/2016 | Slattery | B65D 77/0466 |
| 2016/0237389 | A1* | 8/2016 | Slattery | B65D 21/0209 |
| 2018/0215509 | A1 | 8/2018 | Shoop | |
| 2020/0290768 | A1 | 9/2020 | Paauwe et al. | |
| 2022/0106123 | A1* | 4/2022 | Holmes | B65D 90/623 |
| 2022/0112447 | A1* | 4/2022 | Amurao | B01F 29/34 |

* cited by examiner

LARGE FORMAT CONTAINER

PRIORITY

This disclosure claims priority to U.S. provisional application No. 63/278,853 with a filing date of Nov. 12, 2021. The priority document is incorporated by reference herein.

FIELD

This disclosure is directed to large containers having improved surface properties and reduced contamination, particularly to large containers formed through injection molding.

BACKGROUND

Intermediate bulk containers and other large volume containers can be used for the storage and transport of many different solid or liquid phase materials. These containers can be used for the storage or transportation of reactive chemicals such as various chemicals used in industrial processes such as manufacturing of semiconductor wafers and other contamination-sensitive applications. Polymeric large containers can be used due to cost and reactivity of the polymer compared to, for example, metallic container materials. Polymeric large containers are typically manufactured through rotational molding (roto-molding) or blow molding. While this allows inexpensive creation of large containers, these methods offer poor control regarding the characteristics of the inner surface or formation of particular features. Further, these containers typically need external support such as metal cages.

SUMMARY

This disclosure is directed to large containers having improved surface properties and reduced contamination, particularly to large containers formed through injection molding.

Polymeric large format containers can be formed by injection molding. The pressure applied during injection molding can produce a smoother, harder surface, reducing the surface area that can contribute contaminants and preventing there from being segments that could break off into the contained material. Further, the ability of injection molding to provide sections of differing thicknesses and to form finer internal details can allow the formation of additional features such as integral reinforcement ribs and internal features facilitating the use of the container contents such as rounded corners, sloping surfaces, and the like. Reinforcement ribs can reduce or eliminate the need for external support structures such as metal cages, thus reducing costs and risk of failure associated with those outside supports.

In an embodiment, an article includes a large format container. The large format container includes a polymeric main body including an internal surface defining an interior volume, wherein an arithmetic mean roughness of the internal surface of the polymeric main body is 0.75 μm or less.

In an embodiment, the polymeric main body includes a plurality of integral reinforcement ribs formed in the polymeric main body.

In an embodiment, the interior volume has a volume of between approximately 800 L and approximately 1300 L.

In an embodiment, the polymeric main body includes high density polyethylene (HDPE)

In an embodiment, the large format container further includes a fluoropolymer lining placed within the interior volume.

In an embodiment, an actual surface area of a reference area of the inner surface of the polymeric main body is less than an actual surface area of a reference area of an inner surface of a rotational or blow molded container, the reference area of the inner surface of the polymeric main body having the same size as the reference area of the inner surface of the rotational or blow molded container.

In an embodiment, the container sheds less particulate matter than a rotational or blow molded container.

In an embodiment, the polymeric main body includes one or more channels configured to receive a forklift.

In an embodiment, the polymeric main body is a single molded piece.

In an embodiment, the large format container further includes a lid configured to enclose the interior volume. In an embodiment, the lid includes one or more fill or dispense ports. In an embodiment, the large format container further includes a dip tube connected to one of the one or more fill or dispense ports, the dip tube extending into the interior volume. In an embodiment, the polymeric main body is configured such that a well is provided in the internal surface at a position below the dip tube. In an embodiment the lid is joined to the polymeric main body by a weld. In an embodiment, the internal surface includes a radiused section joining one or more sides of the internal surface to a bottom of the internal surface.

In an embodiment, a method of manufacturing the large format container includes forming the polymeric main body by injection molding. In an embodiment, the injection molding includes applying between approximately 700 bar and approximately 1100 bar of pressure where at least a portion of the internal surface contacts a mold surface. In an embodiment, the method further includes providing a lid and welding said lid to the polymeric main body. In an embodiment, the polymeric main body is formed as a single piece.

DRAWINGS

DETAILED DESCRIPTION

This disclosure is directed to large containers having improved surface properties and reduced contamination, particularly to large containers formed through injection molding.

Figure 1:
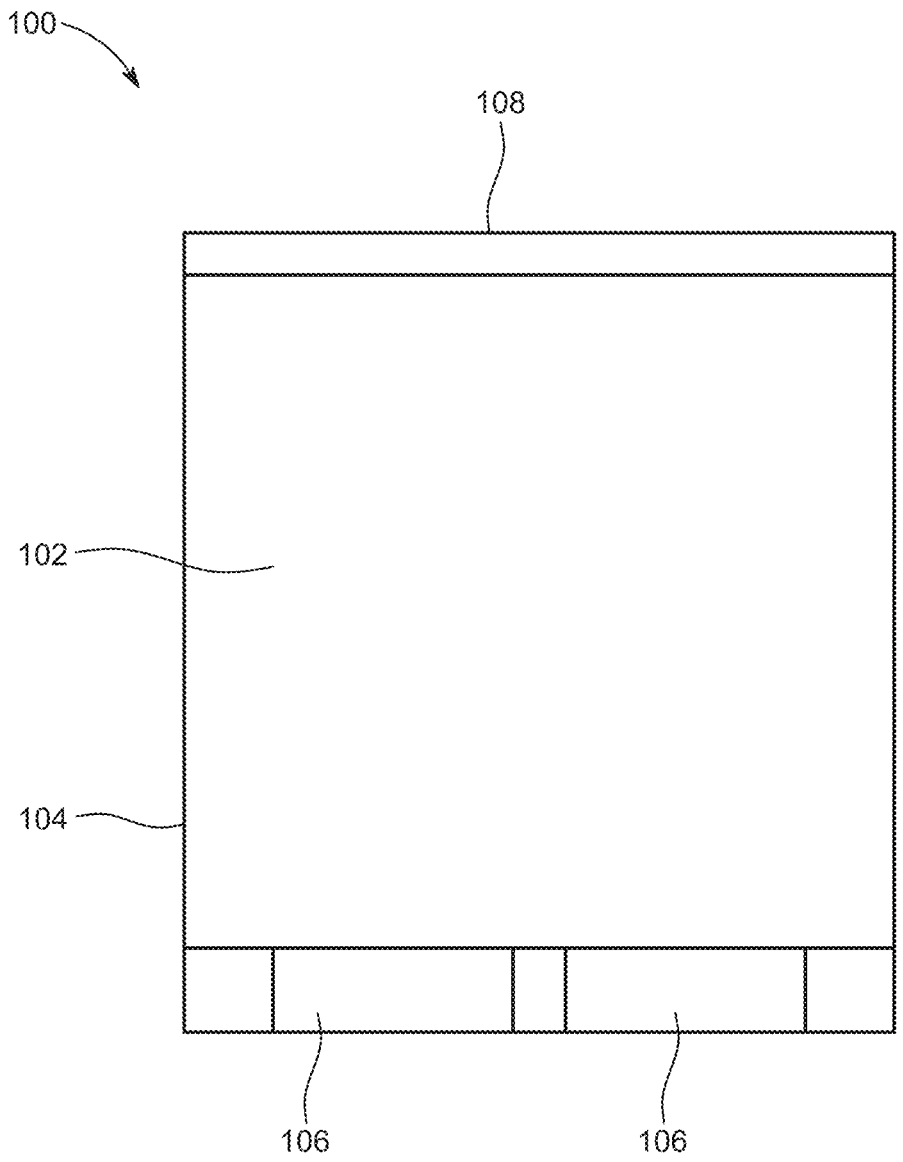
FIG. 1 shows a front view of a container according to an embodiment.

FIG. 1 shows a front view of a container according to an embodiment. Container 100 includes container body 102, with outer surface 104. Optionally, manipulation features 106 can be formed on the container body 102. A lid 108 can cover a top of container body 102.

Container 100 is a large format container, that is, a single container that is capable of storing a large volume, for example, 500 L or more. A large-format container can be a container that requires mechanical assistance to handle and move the container when filled, for example due to containing too much mass to allow lifting by persons without such mechanical assistance. In an embodiment, container 100 is configured to accommodate a volume of between 500 L and 1500 L. One non-limiting example of a class of large format containers is intermediate bulk containers (IBCs). IBCs can be constructed according to standards for transportation containers, such as U.S. Department of Transportation regulations. Standards regarding IBCs can be based on regulations for containers for hazardous materials. In an embodiment, IBCs cannot exceed 3000 L of storage capacity. Container 100 can be used for storing materials such as solid or liquid materials. In embodiments, solid materials may be in the form of a powder. In an embodiment, container 100 can be used to store volatile or reactive materials. In an embodiment, container 100 can be used to store chemicals used in industrial processes such as the processing of wafers such as semiconductor wafers.

Container body 102 is a polymeric main body of the container 100. Container body 102 can be made of any suitable polymeric material. In an embodiment, container body 102 is a melt-processable polymer. In an embodiment, container body 102 is made of high-density polyethylene (HDPE). Container body 102 can include one or more injection molded parts. In an embodiment, container body 102 includes a single injection molded piece. In an embodiment, container body 102 includes a plurality of injection molded portions fixed to one another, for example by way of a weld, such as a heat weld or any other suitable weld for the material used in container body 102. Outer surface 104 is the exterior of the container body 102. In embodiments, the outer surface 104 of container body 102 can include any suitable fine structure including, as a non-limiting example, relief undercuts. In an embodiment, an outer surface of container body 102 can possess a comparatively higher rigidity than a similar outer surface of a container body produced by roto-molding or blow molding. Manipulation features 106 can be formed on the container body 102. The manipulation features can be any suitable mechanical features for engaging with a tool for manipulating container 100. The manipulation features 106 can be in any suitable position for such features, such as being formed on outer surface 104 at one or more side walls of container body 102 and/or a bottom of container body 102. Non-limiting examples of mounting features 106 include channels configured to receive tines of a forklift, projections configured to be engaged by machinery such that the machinery can better grip the container 100, and the like. In the embodiment shown in FIG. 1, the mounting features 106 are channels configured to receive tines of a forklift, located at a bottom portion of the container body 102.

Lid 108 can be provided to enclose the container body 102. Lid 108 can be fixed or joined to container body 102 by any suitable method, such as a weld, mechanical fasteners, mechanical engagement features, or the like.

Figure 2:
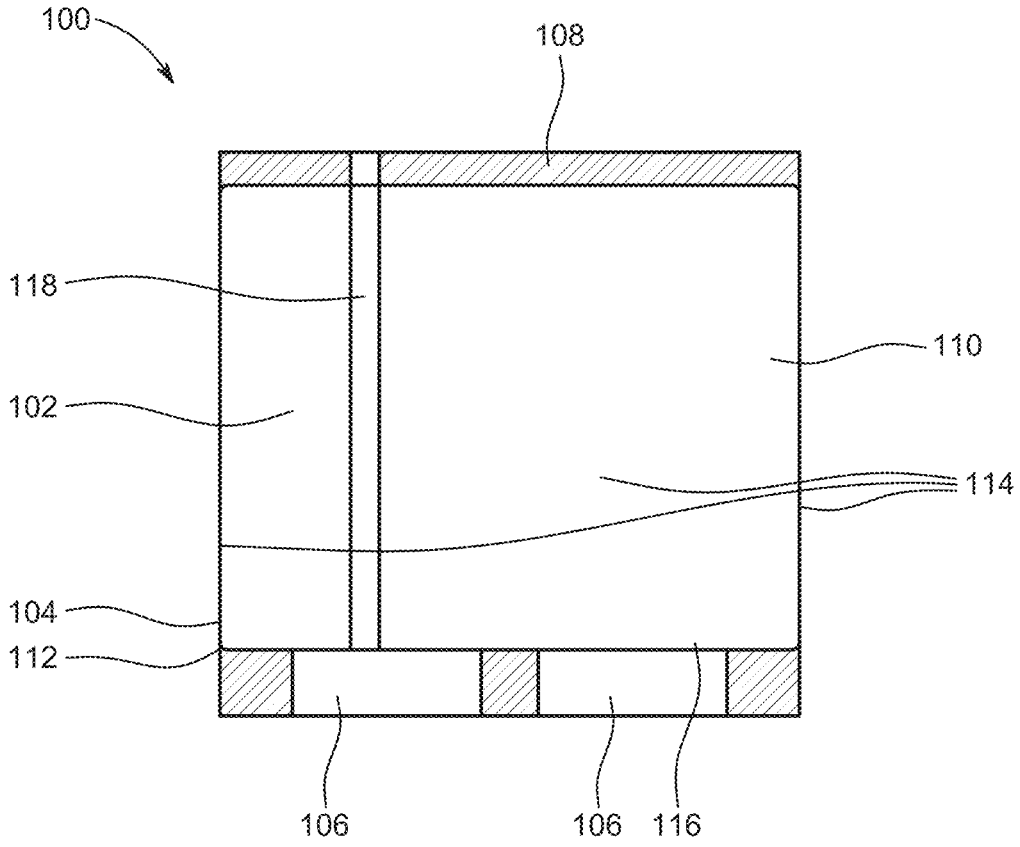
FIG. 2 shows a sectional view of the container of FIG. 1.

FIG. 2 shows a sectional view of a container according to FIG. 1. Container body 102 and its outer surface 104, along with mounting features 106 continue to be visible in the sectional view of FIG. 2. In the sectional view of FIG. 3, an inner surface 110 of the container body 102 is visible. Inner surface 110 includes radiused portions 112 where the side walls 114 of inner surface 110 meet a bottom 116 of the inner surface 110 of container body 102. A dip tube 118 can be seen extending from lid 108 to the interior space defined by inner surface 110.

Figure 3:
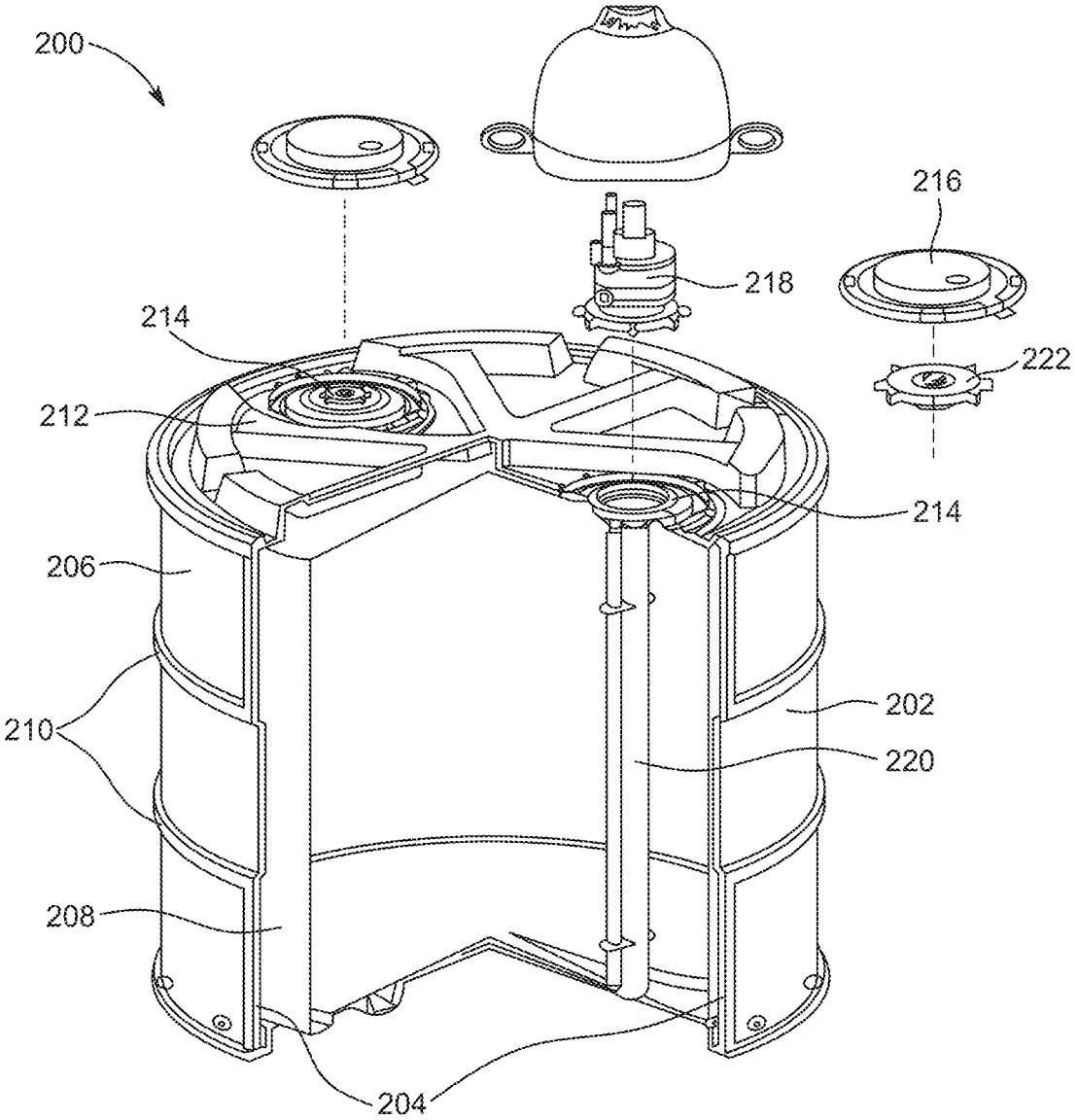
FIG. 3 shows a sectional view of a container according to an embodiment.

FIG. 3 shows a sectional view of a container according to an embodiment. Container 200 includes container body 202, the container body having an inner surface 204 and an outer surface 206. Optionally, a liner 208 can be located within the space defined by inner surface 204. Reinforcement ribs 210 are formed on the outer surface 206. A lid 212 is provided to enclose the container body 202 at one end. The lid 212 can include openings 214. The openings 214 can be provided with a shipping cap 216 or a dispensing head 218. The dispensing head 218 can include a dip tube 220 extending into the internal space within container body 202.

Container body 202 is a polymeric main body of the container 200. Container body 202 can be made of any suitable polymeric material. In an embodiment, container body 202 is a melt-processable polymer. In an embodiment, container body 202 is made of high-density polyethylene (HDPE). Container body 202 can include one or more injection molded parts. In an embodiment, container body 202 includes a single injection molded piece. In an embodiment, container body 202 includes a plurality of injection molded portions fixed to one another, for example by way of a weld, such as a heat weld or any other suitable weld for the material used in container body 202. In the embodiment shown in FIG. 3, container body 202 is a cylindrical main body. In the embodiment shown in FIG. 3, container body 202 has an open end that can be closed by lid 212.

Container body 202 has an inner surface 204 defining an interior space within the container body 202. The inner surface 204 can be formed by a method resulting in high compaction of the inner surface 204 when compared to methods such as rotational or blow molding, such as injection molding. The compaction when forming inner surface 204 can increase a smoothness and/or a surface density of the inner surface 204 compared to rotational or blow molded containers. In an embodiment, the inner surface 204 is less likely to shed particulate compared to an inner surface of a rotational or blow molded container. In an embodiment, the inner surface 204 is formed such that it includes features such as rounded or radiused corners, sloping of the bottom, or any other suitable structural features that can facilitate addition, storage, or removal of materials from the internal space defined by inner surface 204.

Liner 208 can be included in the internal space defined by inner surface 204 of container body 202. Liner 208 can provide a layer between a material being contained within container body 202 and the inner surface 204. Liner 208 can be, for example, a bag configured to be placed within container body 202. The liner 208 can be made of any suitable material for interfacing with the material being contained within container body 202. In an embodiment, the liner 208 includes a fluoropolymer. Liner 208 can be a flexible material. In an embodiment, liner 208 can at least generally conform to a shape of the inner surface 204 when liner 208 is placed into container 200 and liner 208 is filled with a fluid. In an embodiment, liner 208 can be inflated when located in container 200, such that the liner 208 can be made to fill the space within container 200 prior to the filling of liner 208 with a material. In an embodiment, the liner 208 can be a gusseted three-dimensional (3-D) liner. In an embodiment, the liner can include a port at a bottom of the liner 208 such that liner 208 can be gravity drained.

Outer surface 206 is the exterior of container body 202. Reinforcement ribs 210, similar to reinforcement ribs 108 described above and shown in FIG. 1, can be formed on the outer surface 206. Reinforcement ribs 210 can be portions of the container body 202 having a relatively increased thickness from the inner surface 204 to outer surface 206 compared to other portions of the container body 202. The reinforcement ribs 210 can be formed integrally in container body 202, for example by being defined by portions of a mold used in injection molding of container body 202. The reinforcement ribs 210 can increase structural strength of the container body 202, for example to resist shocks during transportation or to resist forces such as the weight of material contained within the container 202.

Lid 212 can be provided to close an open top of container body 202. In an embodiment, lid 212 can be fixed to the container body 202, for example, by a weld. In an embodiment, lid 212 can be attached to the container body by a mechanical connection allowing subsequent separation, for example, by way of, as non-limiting examples, mechanical connection features such as threading, clamps or other mechanical connectors, fasteners such as bolts, and combinations thereof. Lid 212 can be made of any suitable material such as one or more polymer materials. In an embodiment, lid 212 is made of the same material as container body 202. In an embodiment, lid 212 is injection molded from a melt-processable polymer material.

Lid 212 can include one or more openings 214. The openings 214 are openings formed in lid 212 that can allow access to the contents of container body 202 while lid 212 is fixed or attached to container body 202. The openings 214 can have any suitable shape for allowing access to the contents of container body 202, for example to allow filling or removal of material from within container body 202. The openings 214 can be shaped to interface with or receive any suitable tools for assisting in addition or removal of material from container 200, for example to accommodate a particular dispensing tool such as dispensing head 218. Shipping cap 216 is a cap configured to enclose an opening 214 on lid 212. Shipping cap 216 can be sized and shaped such that it can interface with the opening 214 to close the opening 214. Shipping cap 216 can be used during, for example, transit or storage of the container 200. In an embodiment, shipping cap 216 can retain a stopper 222 in opening 214.

Dispensing head 218 can optionally be placed in at least one opening 214 in a lid 212 of container 200. Dispensing head 218 includes a connection interface outside of container 200, allowing the dispensing head 218 to be connected to a device receiving material from inside the container 200. Dispensing head 218 can include a dip tube 220 extending towards a bottom of a container such that the contents at the bottom of container 200 can be drawn into the dip tube 220 and brought through dip tube 220 to dispensing head 218 for removal from the container 200.

The containers such as container 100 and container 200 described above and shown in FIGS. 1 and 2 can be manufactured at least in part by injection molding. The injection molding can include formation of the container body, such as container bodies 102 and 202 as described above and shown in FIGS. 1 and 2. In an embodiment, the container body can be produced by injection molding as a single piece. In an embodiment, the container body can include multiple pieces that are each injection molded separately. The injection molding can include applying between approximately 700 bar and approximately 1100 bar of pressure where at least a portion of the internal surface contacts a mold surface. The injection molding can result in higher compaction of the polymeric material at the inner surface of the container body, resulting in a surface having greater smoothness and/or surface density compared to the inner surfaces of containers made by rotational or blow molding. The injection molding can produce an inner surface less likely to shed material or otherwise contaminate materials stored within the resulting container. Injection molding can allow thickness of the material to vary at different parts of the container body, allowing various structures to be integrally formed into the container body incorporating such changes in thickness. Non-limiting examples of such features include reinforcement ribs, rounding or radiusing of corners, or any other suitable features where a thickness of the container body varies by the particular position on the container body. In embodiments including a lid, such as container 200 including lid 212 described above and shown in FIG. 3, the lid can also be produced by a similar injection molding process. In embodiments including a lid, the lid can optionally be joined to the container body as part of the manufacturing process, for example by a weld.

The inner surfaces of containers according to some embodiments can include shapes and structural features to improve container performance. Non-liming examples include rounded or radiused corners, sloping bottom surfaces, wells, and other such features. These additional features can be structures that may not be present in containers manufactured by other methods such as rotational or blow molding which have less control over internal features. Such structures can include, as non-limiting examples, integral threading, bosses for facilitating fastening of objects or features to the vessel, handles, engagement features such as features for engaging with automation or machines such as forklifts or the like, relief features, and the like.

The increased compaction at the surface can result in a smoother, more consistent surface for the internal surface of the resulting container. The improved surface smoothness can be shown lower variation in height along the surface. In particular, containers formed by injection molding according to embodiments have significantly lower arithmetic mean roughness (Ra) compared to comparable containers formed by roto-molding or blow molding. The arithmetic mean roughness is an average of the absolute value of deviation from that average over the length of the reference line. Example containers were manufactured by way of injection molding, roto-molding, and blow molding of polyethylene (PE). Each of the example containers were manufactured having the same size and shape. Three samples of the interior surface of each of the example containers were measured and the arithmetic mean roughness Ra was obtained for each of the samples. The Ra values for the three samples of each example container were also averaged. The results of these measurements are provided in Tables 1-3 provided below in micrometers (μm) and micro-inches (μin).

TABLE 1

| Injection Mold Surface | | |
|---|---|---|
| Sample | Ra μm | Ra μin |
| 1 | 0.6392 | 25.17 |
| 2 | 0.7357 | 28.96 |
| 3 | 0.7066 | 27.82 |
| Avg | 0.6938 | 27.32 |

TABLE 2

| Blow Mold Surface | | |
|---|---|---|
| Sample | Ra μm | Ra μin |
| 1 | 1.8915 | 74.47 |
| 2 | 1.9717 | 77.63 |
| 3 | 1.9465 | 76.63 |
| Avg | 1.9366 | 76.24 |

TABLE 3

| Roto-mold Surface | | |
|---|---|---|
| Sample | Ra μm | Ra μin |
| 1 | 1.1594 | 45.65 |
| 2 | 1.1795 | 46.44 |
| 3 | 1.1295 | 44.47 |
| Avg | 1.1561 | 45.52 |

The smoother surface provided by the injection molding further results in the same nominal area of the inner surface having a smaller actual surface area than the surfaces provided in blow molded or roto-molded containers. The samples of each of the containers discussed above, each having the same size, had the actual surface areas measured. The samples each had a size of 1416 μm×1062 μm, or 0.056 in ×0.042 in. The actual surface area provided by each of the samples was measured using a surface characterization device (Keyence VK-X2000), and each sample measurement and an average of the samples for each method of manufacture are provided in the following tables:

TABLE 4

| Injection Mold Surface | | |
|---|---|---|
| Sample | Surface Area $\mu M^2$ | Surface Area $in^2$ |
| 1 | 3214070 | 0.00498 |
| 2 | 3341127 | 0.00518 |
| 3 | 3403656 | 0.00528 |
| Avg | 3319618 | 0.00515 |

TABLE 5

| Blow Mold Surface | | |
|---|---|---|
| Sample | Surface Area $\mu M^2$ | Surface Area $in^2$ |
| 1 | 3768660 | 0.00584 |
| 2 | 3710162 | 0.00575 |
| 3 | 3666048 | 0.00568 |
| Avg | 3714957 | 0.00576 |

TABLE 6

| Roto-mold Surface | | |
|---|---|---|
| Sample | Surface Area $\mu M^2$ | Surface Area $in^2$ |
| 1 | 3396409 | 0.00526 |
| 2 | 3424493 | 0.00531 |
| 3 | 3412426 | 0.00529 |
| Avg | 3411109 | 0.00529 |

Figure 4A:
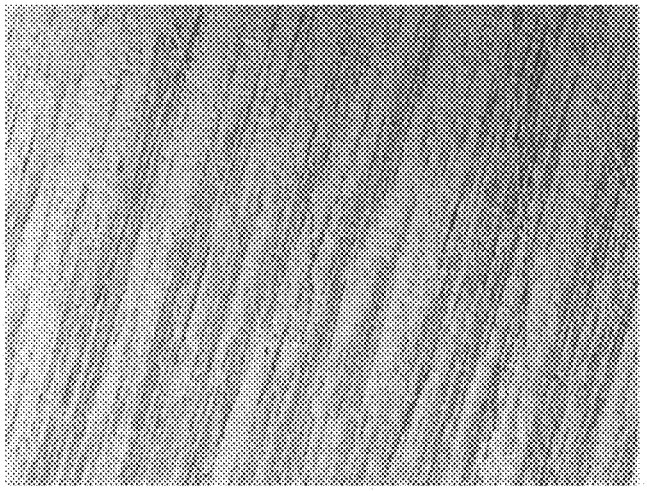
FIG. 4A shows an image of a surface of a container according to an embodiment.
Figure 4B:
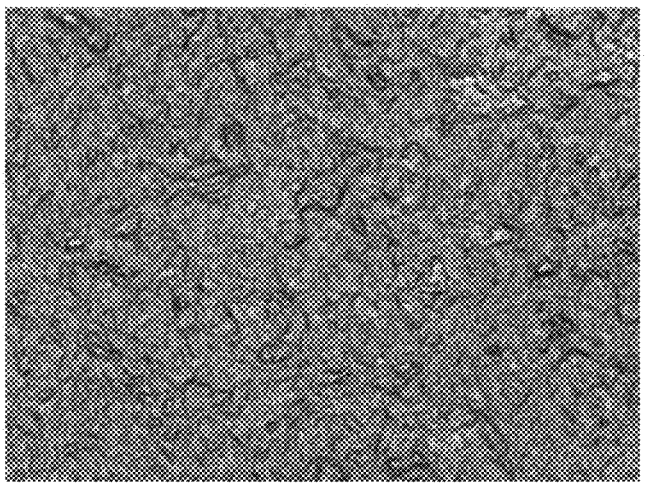
Figure 4B (Prior Art)
FIG. 4B shows an image of a surface of a container according to a standard blow molding process.
Figure 4C:
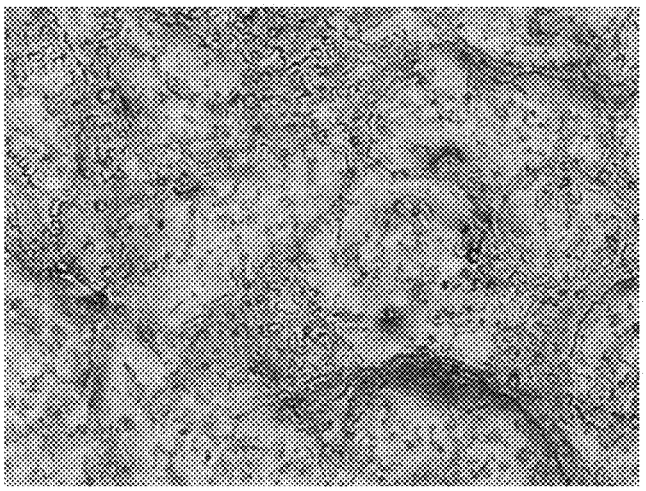
Figure 4C (Prior Art)
FIG. 4C shows an image of a surface of a container according to a standard roto-molding process.

The different characteristics of the injection molded surface compared to can also be seen when the respective surfaces are inspected using a three-dimensional surface profiler to obtain an image of the surface. FIG. 4A shows an image of a surface of a container according to an embodiment. FIG. 4B shows an image of a surface of a container according to a standard blow molding process. FIG. 4C shows an image of a surface of a container according to a standard roto-molding process. Each of FIGS. 4A-4C are of an inner surface of a container according to the respective manufacturing method. The containers used as samples to obtain FIGS. 4A-4C are of the same size and shape, and made from the same material as one another. The microscope images shown in each of FIGS. 4A-4C are taken of their respective samples when at 10× magnification using a Keyence VK-X2000. As can be seen in FIGS. 4A-4C, the sample of the inner surface of the injection-molded container has a significantly smoother surface, whereas the inner surfaces resulting from blow molding and roto-molding of containers having the same size and structure and using the same material result in significantly greater surface variation and features that can break off into material stored within the container, trap some material within the container, provide additional surface area where contamination could leech into materials stored within the container, or the like. The improved flatness and consistency of injection molded samples according to an embodiment compared to roto-molded or blow molded standards thus reduces the risk of contamination and/or improves removal of materials from the container.

Aspects

Aspect 1. An article comprising a large format container, the large format container including a polymeric main body including an internal surface defining an interior volume, wherein an arithmetic mean roughness of the internal surface of the polymeric main body is 0.75 μm or less.

Aspect 2. The article according to aspect 1, wherein the polymeric main body includes a plurality of integral reinforcement ribs formed in the polymeric main body.

Aspect 3. The article according to any of aspects 1-2, wherein the interior volume has a volume of between approximately 800 L and approximately 1300 L.

Aspect 4. The article according to any of aspects 1-3, wherein the polymeric main body includes high density polyethylene (HDPE)

Aspect 5. The article according to any of aspects 1-4, further comprising a fluoropolymer lining placed within the interior volume.

Aspect 6. The article according to any of aspects 1-5, wherein an actual surface area of a reference area of the inner surface of the polymeric main body is less than an actual surface area of a reference area of an inner surface of a rotational or blow molded container, the reference area of the inner surface of the polymeric main body having the same size as the reference area of the inner surface of the rotational or blow molded container.

Aspect 7. The article according to any of aspects 1-6, wherein sheds less particulate matter than a rotational or blow molded container.

Aspect 8. The article according to any of aspects 1-7, wherein the polymeric main body includes one or more channels configured to receive a forklift.

Aspect 9. The article according to any of aspects 1-8, wherein the polymeric main body is a single molded piece.

Aspect 10. The article according to any of aspects 1-9, further comprising a lid configured to enclose the interior volume.

Aspect 11. The article according to aspect 10, wherein the lid includes one or more fill or dispense ports.

Aspect 12. The article according to aspect 11, further comprising a dip tube connected to one of the one or more fill or dispense ports, the dip tube extending into the interior volume.

Aspect 13. The article according to aspect 12, wherein the polymeric main body is configured such that a well is provided in the internal surface at a position below the dip tube.

Aspect 14. The article according to any of aspects 10-13, wherein the lid is joined to the polymeric main body by a weld.

Aspect 15. The article according to any of aspects 1-14, wherein the internal surface includes a radiused section joining one or more sides of the internal surface to a bottom of the internal surface.

Aspect 16. A method of manufacturing the article according to any of aspects 1-15, comprising forming the polymeric main body, wherein forming the polymeric main body includes injection molding.

Aspect 17. The method according to aspect 16, wherein the injection molding includes applying between approximately 700 bar and approximately 1100 bar of pressure where at least a portion of the internal surface contacts a mold surface.

Aspect 18. The method according to any of aspects 16-17, further comprising providing a lid and welding said lid to the polymeric main body.

Aspect 19. The method according to any of aspects 16-18, wherein the polymeric main body is formed as a single piece.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An article comprising a large format container, the large format container including a polymeric main body including an internal surface defining an interior volume, wherein an arithmetic mean roughness of the internal surface of the polymeric main body is 0.75 μm or less, wherein the polymeric main body includes a plurality of integral reinforcement ribs formed in the polymeric main body, wherein the integral reinforcement ribs have a increased thickness relative to other portions of the polymeric main body.

2. The article of claim 1, wherein the interior volume has a volume of between approximately 800 L and approximately 1300 L.

3. The article of claim 1, wherein the polymeric main body includes high density polyethylene (HDPE).

4. The article of claim 1, further comprising a fluoropolymer lining placed within the interior volume.

5. The article of claim 1, wherein an actual surface area of a reference area of the inner surface of the polymeric main body is less than an actual surface area of a reference area of an inner surface of a rotational or blow molded container, the reference area of the inner surface of the polymeric main body having the same size as the reference area of the inner surface of the rotational or blow molded container.

6. The article of claim 1, wherein the container sheds less particulate matter than a rotational or blow molded container.

7. The article of claim 1, wherein the polymeric main body includes one or more channels configured to receive one or more tines of a forklift.

8. The article of claim 1, wherein the polymeric main body is a single molded piece.

9. The article of claim 1, further comprising a lid configured to enclose the interior volume.

10. The article of claim 9, wherein the lid includes one or more fill or dispense ports.

11. The article of claim 10, further comprising a dip tube connected to one of the one or more fill or dispense ports, the dip tube extending into the interior volume.

12. The article of claim 11, wherein the polymeric main body is configured such that a well is provided in the internal surface at a position below the dip tube.

13. The article of claim 9, wherein the lid is joined to the polymeric main body by a weld.

14. The article of claim 1, wherein the internal surface includes a radiused section joining one or more sides of the internal surface to a bottom of the internal surface.

15. A method of manufacturing the article of claim 1 comprising forming the polymeric main body, wherein forming the polymeric main body includes injection molding.

16. The method of claim 15, wherein the injection molding includes applying between approximately 700 bar and approximately 1100 bar of pressure where at least a portion of the internal surface contacts a mold surface.

17. The method of claim 15, further comprising providing a lid and welding said lid to the polymeric main body.

18. The method of claim 15, wherein the polymeric main body is formed as a single piece.

* * * * *